US011549412B2

(12) United States Patent
Osada

(10) Patent No.: US 11,549,412 B2
(45) Date of Patent: Jan. 10, 2023

(54) DIAGNOSIS DEVICE FOR INTERNAL COMBUSTION ENGINE

(71) Applicant: ISUZU MOTORS LIMITED, Tokyo (JP)

(72) Inventor: Hideki Osada, Fujisawa (JP)

(73) Assignee: ISUZU MOTORS LIMITED, Tokyo (JP)

( * ) Notice: Subject to any disclaimer, the term of this patent is extended or adjusted under 35 U.S.C. 154(b) by 0 days.

(21) Appl. No.: 17/439,351

(22) PCT Filed: Mar. 13, 2020

(86) PCT No.: PCT/JP2020/011165
§ 371 (c)(1),
(2) Date: Sep. 14, 2021

(87) PCT Pub. No.: WO2020/189567
PCT Pub. Date: Sep. 24, 2020

(65) Prior Publication Data

US 2022/0195899 A1 Jun. 23, 2022

(30) Foreign Application Priority Data

Mar. 15, 2019 (JP) ..... JP2019-048605

(51) Int. Cl.
*F01M 13/04* (2006.01)
*F02D 41/22* (2006.01)

(52) U.S. Cl.
CPC ..... *F01M 13/04* (2013.01); *F02D 41/222* (2013.01); *F02D 2250/08* (2013.01)

(58) Field of Classification Search
CPC .... F01M 13/04; F02D 41/222; F02D 2250/08
See application file for complete search history.

(56) References Cited

U.S. PATENT DOCUMENTS 5,317,909 A * 6/1994 Yamada ..... F02M 25/0809 73/114.39
6,067,498 A 5/2000 Akiyama
(Continued)

FOREIGN PATENT DOCUMENTS

JP S61-005309 1/1986
JP H04-019312 A 1/1992
(Continued)

OTHER PUBLICATIONS

International Search Report, Application No. PCT/JP2020/011165, dated Jun. 2, 2020, in 5 pages.
PCT/ISA/237.

*Primary Examiner* — Kurt Philip Liethen
(74) *Attorney, Agent, or Firm* — Procopio, Cory, Hargreaves & Savitch LLP

(57) ABSTRACT

Provided is a diagnosis device for an internal combustion engine where the internal combustion engine includes a blow-by gas passage through which blow-by gas flows and the diagnosis device includes a temperature sensor which detects a temperature inside the blow-by gas passage and an abnormality detection unit which detects an abnormality in the internal combustion engine based on a detected value of the temperature sensor.

5 Claims, 9 Drawing Sheets

(56) References Cited

U.S. PATENT DOCUMENTS

| | | | | |
|---|---|---|---|---|
| 6,175,788 | B1 * | 1/2001 | Hasegawa | B60G 17/0185 701/33.9 |
| 6,435,018 | B1 * | 8/2002 | Murakami | G01M 17/007 340/992 |
| 6,575,022 | B1 * | 6/2003 | Schneider | F01M 13/00 73/114.01 |
| 6,691,687 | B1 * | 2/2004 | Liang | F01M 13/04 123/573 |
| 7,878,049 | B2 * | 2/2011 | Roal | G01M 15/09 73/114.37 |
| 7,913,676 | B2 * | 3/2011 | Breuninger | F01M 13/022 123/73 V |
| 2002/0104517 | A1 * | 8/2002 | Shea | F02M 25/06 123/572 |
| 2005/0022795 | A1 * | 2/2005 | Beyer | F01M 11/10 73/114.38 |
| 2006/0243258 | A1 * | 11/2006 | Withrow | F02M 25/0818 123/573 |
| 2014/0330482 | A1 * | 11/2014 | Yang | F02M 25/0809 701/34.4 |
| 2015/0345435 | A1 * | 12/2015 | Yang | F02M 25/0809 123/520 |
| 2016/0153384 | A1 * | 6/2016 | Ulrey | F02D 41/064 123/464 |
| 2018/0306074 | A1 * | 10/2018 | Kayama | F01M 13/00 |

FOREIGN PATENT DOCUMENTS

| | | | |
|---|---|---|---|
| JP | H11-148417 | A | 6/1999 |
| JP | 2019-007472 | A | 1/2019 |

* cited by examiner

DIAGNOSIS DEVICE FOR INTERNAL COMBUSTION ENGINE

TECHNICAL FIELD

The present disclosure relates to a diagnosis device for an internal combustion engine.

BACKGROUND ART

In the internal combustion engine, a blow-by gas processing device which releases blow-by gas leaked into a crankcase from a gap between a piston and a cylinder to the atmosphere or returns it to an intake passage is known.

CITATION LIST

Patent Literature

Patent Literature 1: JP-UM-A-561-5309

SUMMARY OF INVENTION

Technical Problem

By the way, in the internal combustion engine, when a piston ring attached to the piston wears, for example, an abnormality such as an increase in blow-by gas may occur. Such an abnormality increases an amount of oil contained in the blow-by gas and cause malfunctions of the internal combustion engine, so the abnormality needs to be detected promptly.

The present disclosure provides a diagnosis device capable of detecting an abnormality in an internal combustion engine.

Solution to Problem

According to an aspect of the present disclosure, there is provided a diagnosis device for an internal combustion engine where the internal combustion engine includes a blow-by gas passage through which blow-by gas flows and where the diagnosis device includes a temperature sensor which detects a temperature inside the blow-by gas passage and an abnormality detection unit which detects an abnormality in the internal combustion engine based on a detected value of the temperature sensor.

The abnormality detection unit may detect an abnormality by comparing the detected value of the temperature sensor with a threshold value and correct the threshold value based on at least one of an atmospheric temperature, a temperature of engine oil, and a temperature of engine cooling water.

In addition, the abnormality detection unit may correct the threshold value to a higher value as at least one of the atmospheric temperature, the temperature of engine oil, and the temperature of engine cooling water is higher.

In addition, the internal combustion engine may further include an oil separator provided in the blow-by gas passage for separating oil from blow-by gas and the temperature sensor may be located in the blow-by gas passage on a downstream side of the oil separator.

In addition, a downstream side end portion of the blow-by gas passage may be open to the atmosphere and the temperature sensor may be located at the downstream side end portion of the blow-by gas passage.

Advantageous Effects of Invention

With the diagnosis device according to the present disclosure, an abnormality of the internal combustion engine can be detected based on the temperature in the blow-by gas passage.

DESCRIPTION OF EMBODIMENTS

Figure 1:
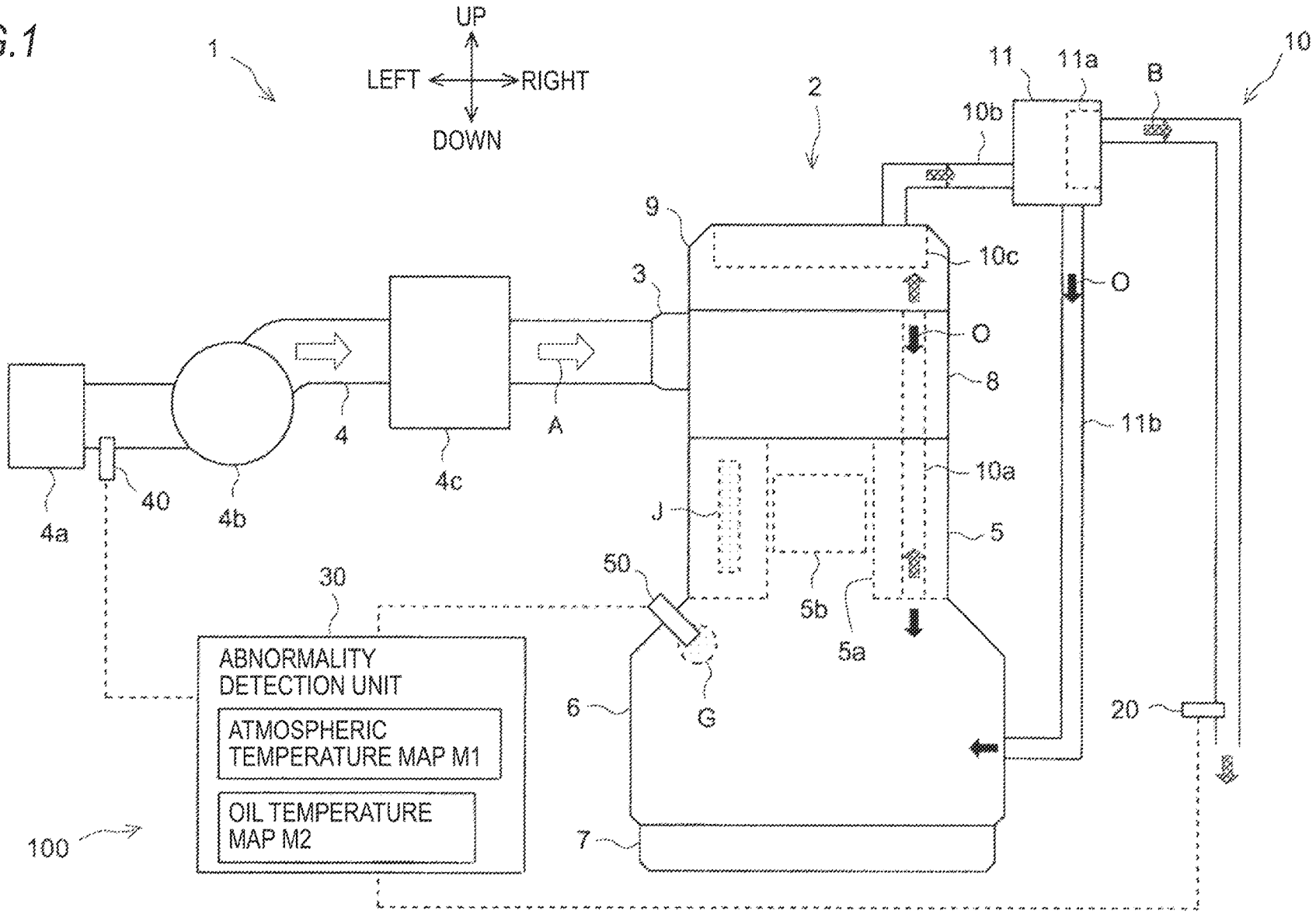
FIG. 1 is a schematic configuration diagram of an internal combustion engine.

Hereinafter, embodiments of the present disclosure will be described with reference to the accompanying drawings. It should be noted that the present disclosure is not limited to the following embodiments. In addition, each of the up, down, left, and right directions illustrated in the figure is merely defined for convenience of explanation.

First, a schematic configuration of an internal combustion engine 1 will be described with reference to FIG. 1. In the figure, a white arrow A indicates flow of intake air and a shaded arrow B indicates flow of blow-by gas. Also, a black arrow O indicates flow of oil separated from the blow-by gas.

The internal combustion engine 1 is a multi-cylinder compression-ignition-type internal combustion engine, that is, a diesel engine mounted on a vehicle (not illustrated). The vehicle is a large vehicle such as a truck. However, there are no particular limitations on the type, form, use, and the like of the vehicle and the internal combustion engine 1. For example, the vehicle may be a small vehicle such as a passenger car, or the internal combustion engine 1 may be a spark-ignition-type internal combustion engine, that is, a gasoline engine.

The internal combustion engine 1 includes an engine body 2, an intake manifold 3 connected to the engine body 2, and an intake pipe 4 connected to an upstream end of the intake manifold 3. The internal combustion engine 1 also includes exhaust system parts such as an exhaust pipe (not illustrated), but the description thereof will be omitted here.

Further, as will be described in detail below, the internal combustion engine 1 of the embodiment includes a blow-by gas passage 10 through which blow-by gas flows. Further, the internal combustion engine 1 includes an oil separator 11 for separating oil from the blow-by gas.

The engine body 2 includes a cylinder block 5, a crankcase 6 integrally formed at a lower part of the cylinder block 5, and an oil pan 7 connected to a lower part of the crankcase 6. Further, the engine body 2 includes a cylinder head 8 connected to an upper part of the cylinder block 5 and a head cover 9 connected to an upper part of the cylinder head 8.

A plurality of cylinders 5*a* are provided in the cylinder block 5 and a piston 5*b* is accommodated in each cylinder 5*a*. A crankshaft (not illustrated) is accommodated in the crankcase 6 and engine oil is stored in the oil pan 7. Further, a valve operating mechanism (not illustrated) is attached to the cylinder head 8 and the valve operating mechanism is covered from above by the head cover 9. An oil gallery G in which engine oil is stored is formed in the crankcase 6. Further, a water jacket J through which engine cooling water is circulated is formed in the cylinder block 5 and the cylinder head 8.

The intake manifold 3 is connected to the cylinder head 8 and distributes and supplies the intake air sent from the intake pipe 4 to an intake port of each cylinder 5*a*. The intake pipe 4 is provided with an air cleaner 4*a*, a turbocharger compressor 4*b*, and an intercooler 4*c* in this order from the upstream side.

The blow-by gas passage 10 includes an in-engine passage 10*a* which passes through the inside of the engine body 2 and a blow-by gas pipe 10*b* exposed to the outside of the engine body 2 in order from the upstream side in a blow-by gas flow direction. As is well known, blow-by gas is gas which leaks into the crankcase 6 from a gap between the cylinder 5*a* and the piston 5*b* in the engine body 2. Although not illustrated, an amount of blow-by gas in the crankcase 6 is minimized by a plurality of piston rings attached to the pistons 5*b*.

The in-engine passage 10*a* passes through the inside of the cylinder block 5 and the cylinder head 8 from the inside of the crankcase 6 and communicates with the inside of the head cover 9.

For the blow-by gas pipe 10*b*, for example, a resin hose member is used. An upstream end of the blow-by gas pipe 10*b* is connected to an upper surface portion of the head cover 9. On the other hand, a downstream end of the blow-by gas pipe 10*b* is opened to the atmosphere at a height near a lower end of the engine body 2.

The in-engine passage 10*a* and the blow-by gas pipe 10*b* communicate with each other via an oil separation chamber 10*c* provided in an upper part of the head cover 9. Although not illustrated, the oil separation chamber 10*c* has a plurality of baffle plates and is configured to collide the blow-by gas introduced from the in-engine passage 10*a* with the baffle plates to separate the oil. Further, the oil separated from the blow-by gas is returned from the oil separation chamber 10*c* into the crankcase 6 through the in-engine passage 10*a*.

An oil separator 11 is provided outside the engine body 2 and in the middle of the blow-by gas pipe 10*b*. The oil separator 11 includes a filter element 11*a* for separating oil from the blow-by gas. However, the type of the oil separator 11 may be arbitrary and may be, for example, a centrifugal oil separator having no filter element.

Further, a return pipe 11*b* for returning oil O separated from the blow-by gas into the crankcase 6 is connected to the oil separator 11 of the embodiment. Further, although not illustrated, the oil separator 11 is provided with a bypass flow path for adjusting a flow rate which bypasses the filter element 11*a* and an on-off valve which opens and closes the bypass flow path.

According to the configuration described above, as illustrated by the arrow B in FIG. 1, while the internal combustion engine 1 is in operation, the blow-by gas in the crankcase 6 flows through the in-engine passage 10*a* and the blow-by gas pipe 10*b* in this order and is released into the atmosphere. In this case, the oil contained in the blow-by gas is separated from the blow-by gas by the oil separation chamber 10*c* and the oil separator 11.

Further, as illustrated by the arrow O in FIG. 1, the oil separated in the oil separation chamber 10*c* is returned to the crankcase 6 through the in-engine passage 10*a*. The oil separated by the oil separator 11 is returned to the crankcase 6 through the return pipe 11*b*.

Next, a diagnosis device 100 of the internal combustion engine 1 will be described in detail.

In the internal combustion engine 1, for example, an abnormality may occur in which the blow-by gas in the crankcase 6 increases due to wear or damage of the piston ring.

When the blow-by gas increases, the pressure inside the crankcase 6 increases. Therefore, it becomes difficult for the oil discharged from the oil separation chamber 10*c* to return to the inside of the crankcase 6 through the in-engine passage 10*a*. Also, the oil may flow back in the oil separation chamber 10*c* and flow into the blow-by gas pipe 10*b* together with the blow-by gas. Therefore, the blow-by gas containing a large amount of oil flows through the oil separator 11 and the blow-by gas on the downstream side of the oil separator 11 also contains a large amount of oil. As a result, a larger amount of oil than in a normal state may be released into the atmosphere.

Further, in the oil separator 11, abnormalities such as the on-off valve of the bypass flow path not closing and the connection flow path with the return pipe 11*b* being blocked may generate. In this case as well, there is a risk that a larger amount of oil than in the normal state will be released into the atmosphere.

Further, in the crankcase 6, when the blow-by gas increases, dilution of the engine oil due to the blow-by gas is likely to occur. Dilution causes the internal combustion engine 1 to fail.

In this respect, the inventor of the present application has newly discovered that the temperature (hereinafter, the in-pipe temperature) inside the blow-by gas pipe 10*b* tends to rise due to the heat of the oil contained in the blow-by gas when the above-described abnormality of the internal combustion engine 1 occurs. That is, the temperature of the oil contained in the blow-by gas is higher than the temperature of the blow-by gas itself. Therefore, under normal conditions, blow-by gas containing almost no oil flows in the blow-by gas pipe 10*b*, so that the in-pipe temperature becomes low. However, in the event of an abnormality, the blow-by gas containing a large amount of oil flows through the blow-by gas pipe 10*b*, so that the in-pipe temperature rises.

Therefore, the diagnosis device 100 of the embodiment includes a temperature sensor 20 which detects the in-pipe temperature and an abnormality detection unit 30 which detects an abnormality in the internal combustion engine 1 based on a detected value (hereinafter, a detected in-pipe temperature) of the temperature sensor 20.

Specifically, the temperature sensor 20 is attached to the blow-by gas pipe 10*b*. Although not illustrated, the abnormality detection unit 30 is composed of an electronic control unit (ECU) or a controller of the vehicle and includes a CPU, a ROM, a RAM, an input and output port, and the like. Further, the temperature sensor 20 is electrically connected to the abnormality detection unit 30.

Figure 2:
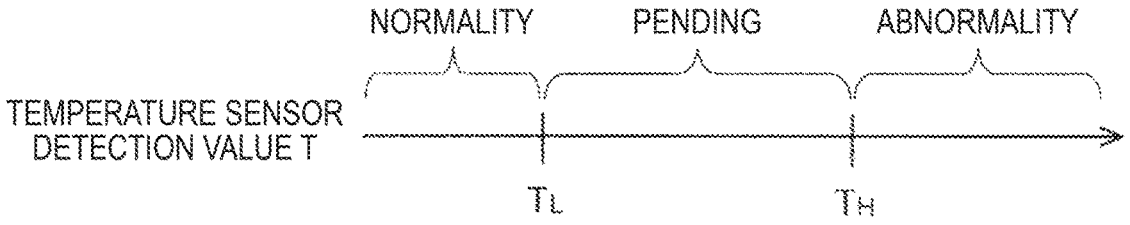
FIG. 2 is a diagram illustrating a temperature in a blow-by gas passage and a threshold value thereof.

As illustrated in FIG. 2, the abnormality detection unit 30 compares a detected in-pipe temperature T with a predetermined normality threshold value $T_L$ and detects that the internal combustion engine 1 is normal when the in-pipe temperature T is equal to or less than the normality threshold value $T_L$. Further, the abnormality detection unit 30 compares the detected in-pipe temperature T with a predetermined abnormality threshold value $T_H$ and detects that the internal combustion engine 1 is abnormal when the detected in-pipe temperature T is equal to or higher than the abnormality threshold value $T_H$. The abnormality threshold value $T_H$ corresponds to a threshold value described in the claims and is set to a temperature higher than the normality threshold value $T_L$($T_H$>$T_L$). Then, when the abnormality detection unit 30 detects an abnormality in the internal combustion engine 1, a warning lamp (not illustrated) is turned on to notify a driver of the abnormality.

Therefore, the diagnosis device 100 according to the embodiment can detect an abnormality in the internal combustion engine 1 based on the temperature in the blow-by gas passage 10.

Further, the abnormality detection unit 30 of the embodiment holds this state without detecting the normality or abnormality of the internal combustion engine 1 when the detected in-pipe temperature T is less than the abnormality threshold value $T_H$ and higher than the normality threshold value $T_L$. This enables reliable detection in consideration of the variation in the detected in-pipe temperature T.

Further, as illustrated in FIG. 1, the temperature sensor 20 of the embodiment is located on the blow-by gas pipe 10*b* on the downstream side of the oil separator 11. Although not illustrated, if the temperature sensor 20 is located on the blow-by gas pipe 10*b* on the upstream side of the oil separator 11, the detected in-pipe temperature becomes high even under normal conditions due to the blow-by gas before oil separation. Further, for example, even when the oil separator 11 is not provided on the blow-by gas pipe 10*b*, the detected in-pipe temperature may be high due to a similar reason. In these cases, a difference between the detected in-pipe temperatures T in the normal state and the abnormal state becomes small, and thus detection accuracy may decrease.

On the other hand, the temperature sensor 20 of the embodiment is located on the blow-by gas pipe 10*b* on the downstream side of the oil separator 11 and detects the temperature inside the pipe through which the blow-by gas flows after the oil is separated. Therefore, the detected in-pipe temperature T can be lowered in the normal state and the detected in-pipe temperature T can be raised in the abnormal state. As a result, a temperature difference between the normal state and the abnormal state becomes clear, and thus the detection accuracy can be improved.

Further, the temperature sensor 20 of the embodiment is located at a downstream side end portion of the blow-by gas pipe 10*b* opened to the atmosphere. In this way, at the time of the normal state, the temperature sensor 20 is susceptible to atmospheric temperature, so the detected in-pipe temperature T tends to be lower. On the other hand, at the time of the abnormal state, the detected in-pipe temperature T becomes high due to the influence of the heat of the oil contained in the blow-by gas. As a result, the temperature difference between the normal state and the abnormal state becomes more remarkable, and thus the detection accuracy of the normal state and the abnormal state can be improved.

Further, the detected in-pipe temperature T becomes higher as the atmospheric temperature and the engine oil temperature (hereinafter referred to as oil temperature) are higher. Therefore, when the above-described normality threshold value $T_L$ and the abnormality threshold value $T_H$ remain constant, there is a possibility that normal or abnormal is erroneously detected due to the atmospheric temperature and the oil temperature.

Therefore, the abnormality detection unit 30 of the embodiment corrects the normality threshold value $T_L$ and the abnormality threshold value $T_H$ based on the atmospheric temperature and the oil temperature.

Specifically, the diagnosis device 100 of the embodiment further includes an atmospheric temperature sensor 40 for detecting the atmospheric temperature and an oil temperature sensor 50 for detecting the oil temperature.

An air flow meter capable of detecting the intake flow rate and the atmospheric temperature is used for the atmospheric temperature sensor 40. The atmospheric temperature sensor 40 is attached to a part of the intake pipe 4 which is the part located on the upstream side of the compressor 4*b* and on the immediately downstream side of the air cleaner 4*a* in the intake flow direction. The oil temperature sensor 50 is attached to the oil gallery G of the crankcase 6. The atmospheric temperature sensor 40 and the oil temperature sensor 50 are electrically connected to the abnormality detection unit 30.

Figure 3:
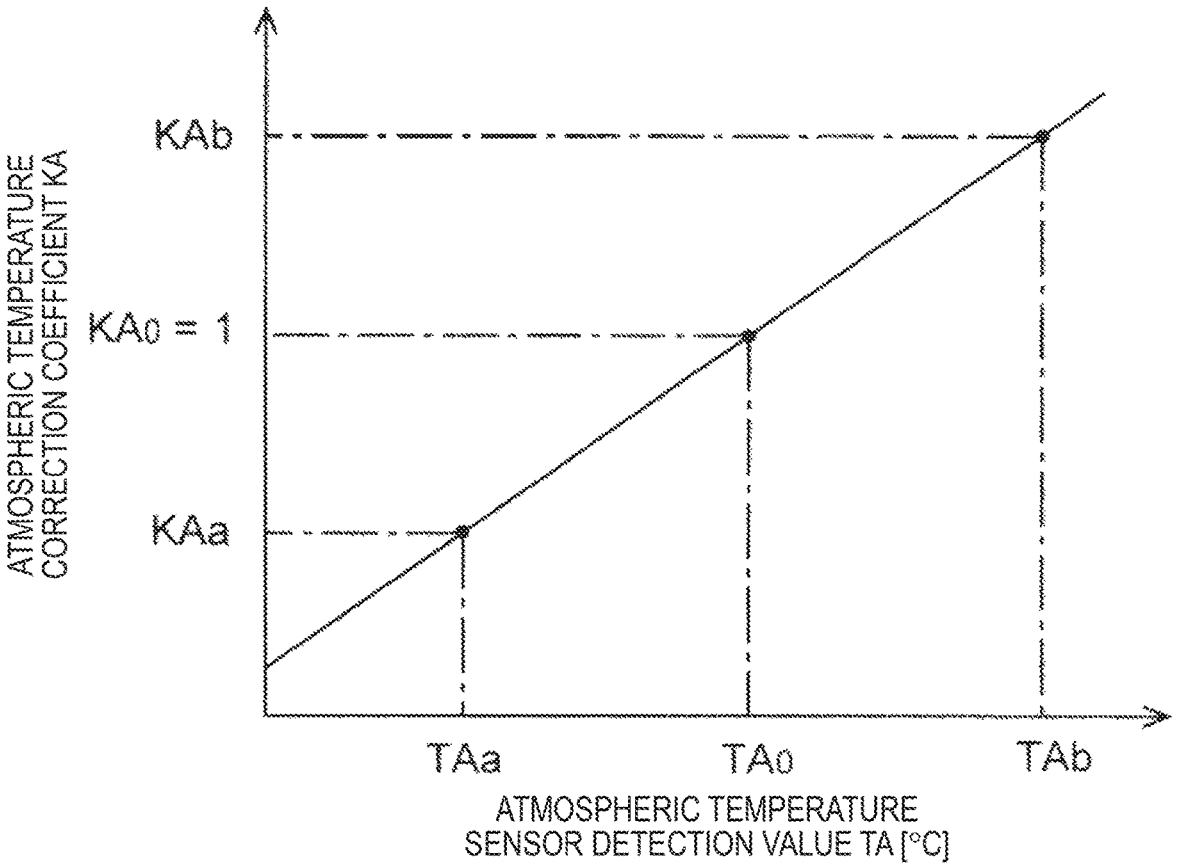
FIG. 3 is a map which defines a relationship between the atmospheric temperature and a correction coefficient corresponding to the temperature.

Also, as illustrated in FIG. 3, the abnormality detection unit 30 includes an atmospheric temperature map M1 which defines a relationship between a detected value (hereinafter, a detected atmospheric temperature) TA of the atmospheric temperature sensor 40 and a correction coefficient (hereinafter, an atmospheric temperature correction coefficient) KA corresponding to the detected atmospheric temperature TA.

In the atmospheric temperature map M1, the relationship between the detected atmospheric temperature TA and the atmospheric temperature correction coefficient KA is set so that the higher the detected atmospheric temperature TA is, the larger the atmospheric temperature correction coefficient KA is. Further, the atmospheric temperature map M1 stores a reference atmospheric temperature correction coefficient $KA_0$ ($KA_0$=1) corresponding to a predetermined reference atmospheric temperature $TA_0$ (for example, 25° C.).

In the illustrated example, an atmospheric temperature correction coefficient KAa (KAa<$KA_0$), which is smaller than the reference atmospheric temperature correction coefficient $KA_0$, is acquired corresponding to a detected atmospheric temperature TAa (TAa<$TA_0$) lower than the reference atmospheric temperature $TA_0$. Also, an atmospheric temperature correction coefficient KAb (KAb>$KA_0$) larger than the reference atmospheric temperature correction coefficient $KA_0$ is acquired corresponding to a detected atmospheric temperature TAb (TAb>$TA_0$) higher than the reference atmospheric temperature $TA_0$.

Figure 4:
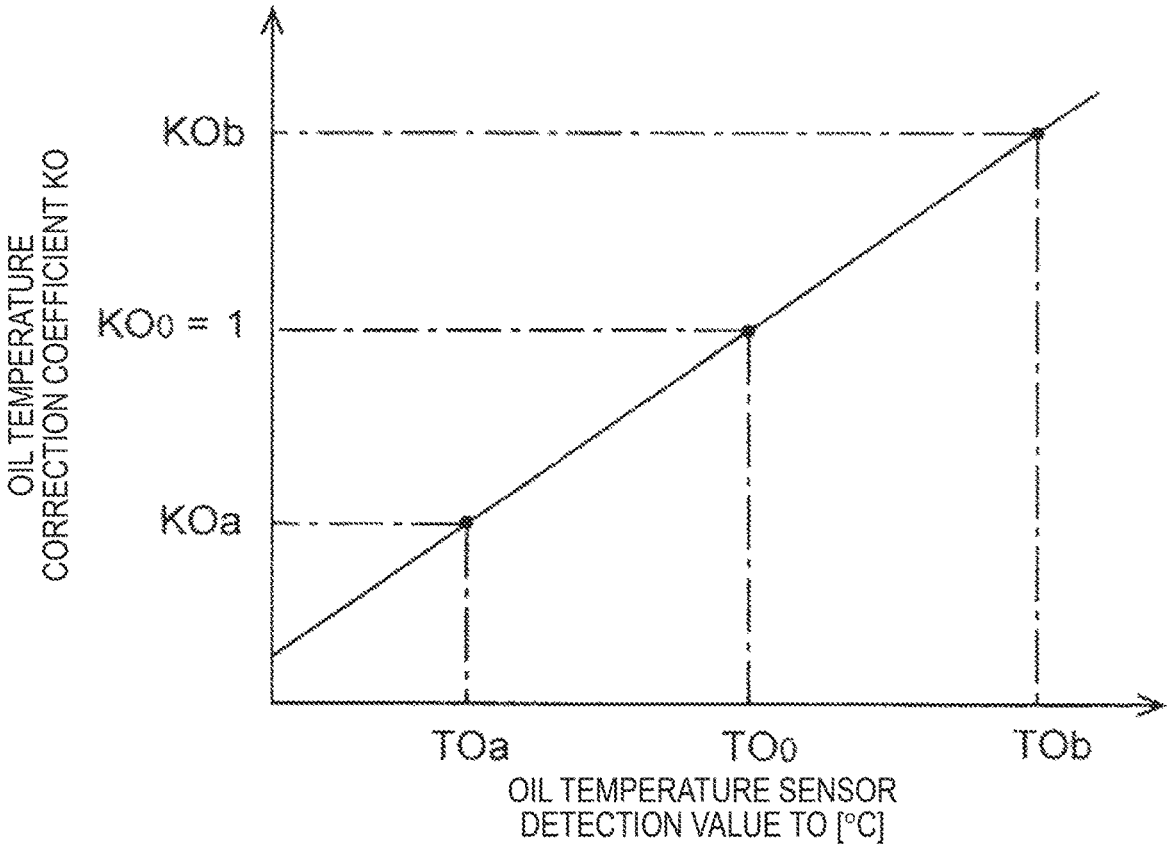
FIG. 4 is a map which defines a relationship between a temperature of engine oil and a correction coefficient corresponding to the temperature.

Also, as illustrated in FIG. 4, the abnormality detection unit 30 includes an oil temperature map M2 which defines a relationship between a detected value (hereinafter, detected oil temperature) TO of the oil temperature sensor 50 and a correction coefficient (hereinafter, oil temperature correction coefficient) KO corresponding to the detected oil temperature TO.

In the oil temperature map M2, the relationship between the detected oil temperature TO and the oil temperature correction coefficient KO is set so that the higher the detected oil temperature TO is, the larger the oil temperature correction coefficient KO is. Further, the oil temperature map M2 stores a reference oil temperature correction coefficient $KO_0$ ($KO_0$=1) corresponding to a predetermined reference oil temperature $TO_0$ (for example, 90° C.).

In the illustrated example, an oil temperature correction coefficient KOa (KOa<$KO_0$) smaller than the reference oil temperature correction coefficient $KO_0$ is acquired corresponding to a detected oil temperature TOa (TOa<$TO_0$) lower than the reference oil temperature $TO_0$. Also, an oil temperature correction coefficient KOb (KOb>$KO_0$) larger than the reference oil temperature correction coefficient $KO_0$ is acquired corresponding to a detected oil temperature TOb (TOb>$TO_0$) higher than the reference oil temperature $TO_0$.

The abnormality detection unit 30 calculates the corrected normality threshold value $T_L$ by multiplying a reference normality threshold value $T_{L0}$ before correction by the atmospheric temperature correction coefficient KA and the oil temperature correction coefficient KO ($T_L$=$T_{L0}$×KA×KO). Further, the abnormality detection unit 30 calculates the corrected abnormality threshold value $T_H$ by multiplying a reference abnormality threshold value $T_{H0}$ before correction by the atmospheric temperature correction coefficient KA and the oil temperature correction coefficient KO ($T_H$=$T_{H0}$×KA×KO).

Therefore, the normality threshold value $T_L$ and the abnormality threshold value $T_H$ are corrected to higher values as the detected atmospheric temperature TA and the detected oil temperature TO are higher and are corrected to lower values as the detected atmospheric temperature TA and the detected oil temperature TO are lower. As a result, erroneous detection due to the atmospheric temperature and the oil temperature can be suppressed.

Next, a control routine of the abnormality detection unit 30 will be described with reference to FIG. 5.

Figure 5:
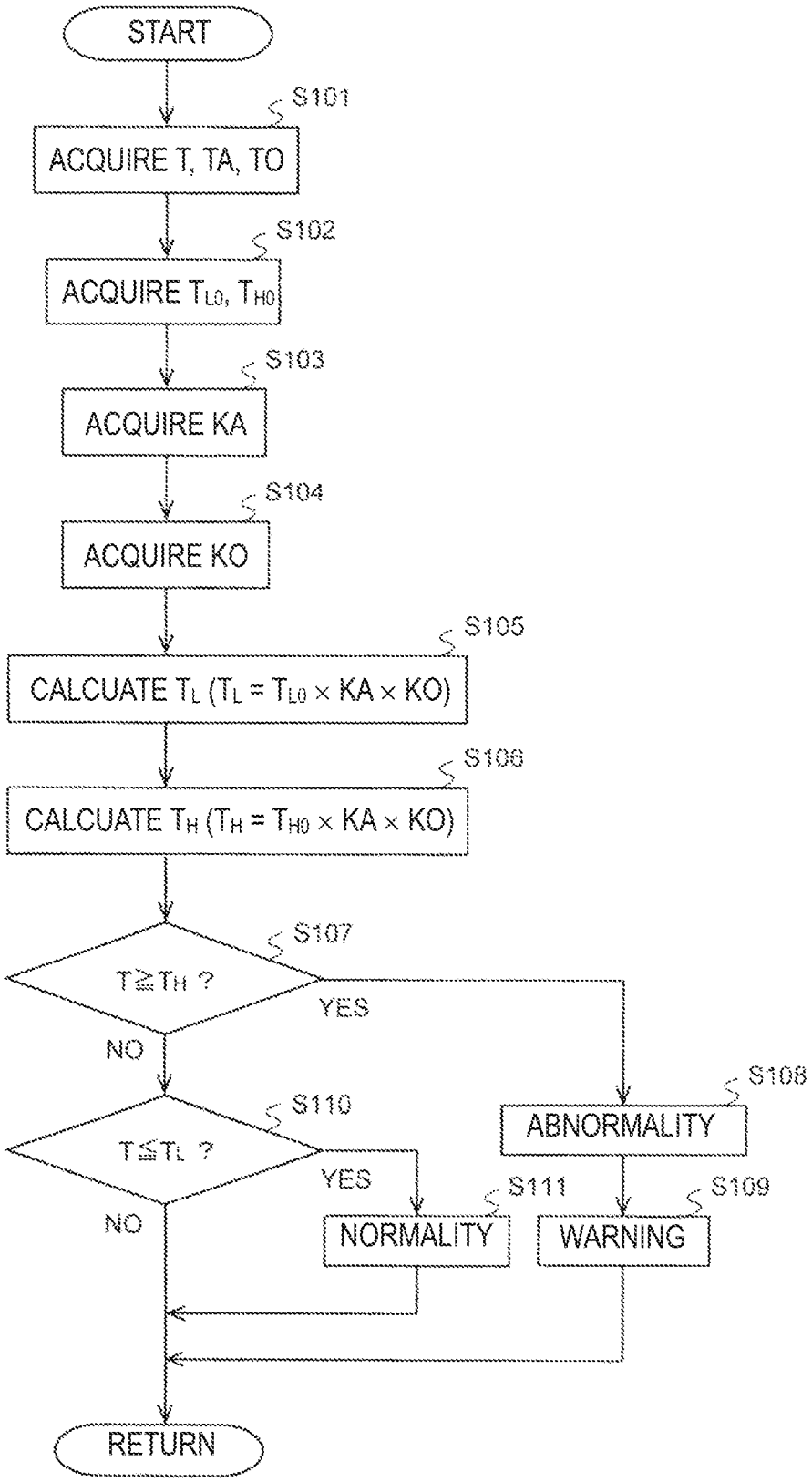
FIG. 5 is a diagram illustrating a control flow of an abnormality detection unit.

The abnormality detection unit 30 repeatedly executes a control flow of FIG. 5 at predetermined calculation cycles (for example, 10 ms) while the internal combustion engine 1 is in a predetermined operation state (for example, idle operation state). As a result, the in-pipe temperature and the oil temperature, which fluctuate depending on the operation state of the internal combustion engine 1, can be detected under certain conditions.

In Step S101, the detected in-pipe temperature T, the detected atmospheric temperature TA, and the detected oil temperature TO are acquired. In Step S102, the reference normality threshold value $T_{L0}$ and the reference abnormality threshold value $T_{H0}$ are acquired.

In Step S103, the atmospheric temperature correction coefficient KA corresponding to the detected atmospheric temperature TA is acquired by referring to the atmospheric temperature map M1.

In Step S104, the oil temperature correction coefficient KO corresponding to the detected oil temperature TO is acquired by referring to the oil temperature map M2.

In Step S105, the corrected normality threshold value $T_L$ is calculated by multiplying the reference normality threshold value $T_{L0}$ by the atmospheric temperature correction coefficient KA and the oil temperature correction coefficient KO ($T_L$=$T_{L0}$×KA×KO).

In Step S106, the corrected abnormality threshold value $T_H$ is calculated by multiplying the reference abnormality threshold value $T_{H0}$ by the atmospheric temperature correction coefficient KA and the oil temperature correction coefficient KO ($T_{H0}$×KA×KO).

In Step S107, it is determined whether the detected in-pipe temperature T acquired in Step S101 is equal to or greater than the abnormality threshold value $T_H$ (T≥$T_H$). When it is determined in Step S107 that the detected in-pipe temperature T is equal to or greater than the abnormality threshold value $T_H$ (T≥$T_H$) (YES), the process proceeds to Step S108 and it is detected that the internal combustion engine 1 is abnormal. Then, the process proceeds to Step S109 and a warning lamp is turned on, and then the process returns.

On the other hand, when it is determined in Step S107 that the detected in-pipe temperature T is not equal to or greater than the abnormality threshold value $T_H$ (T≥$T_H$) (NO), the process proceeds to Step S110 and it is determined whether the detected in-pipe temperature T is equal to or less than the normality threshold value $T_L$ (T≤$T_L$).

When it is determined in Step S110 that the detected in-pipe temperature T is equal to or less than the normality threshold value $T_L$ (T≤$T_L$) (YES), the process proceeds to Step S111 and it is detected that the internal combustion engine 1 is normal, and then the process returns.

On the other hand, when it is determined in Step S110 that the detected in-pipe temperature T is not equal to or less than the normality threshold value $T_L$ (T≤$T_L$) (NO), the process returns in a pending state in which neither abnormality nor normality is detected.

The embodiment described above can be modification examples as follows or a combination thereof. In the following description, the same reference numerals and letters are used for the same components as those in the embodiment described above and detailed description thereof will be omitted.

FIRST MODIFICATION EXAMPLE

Figure 6:
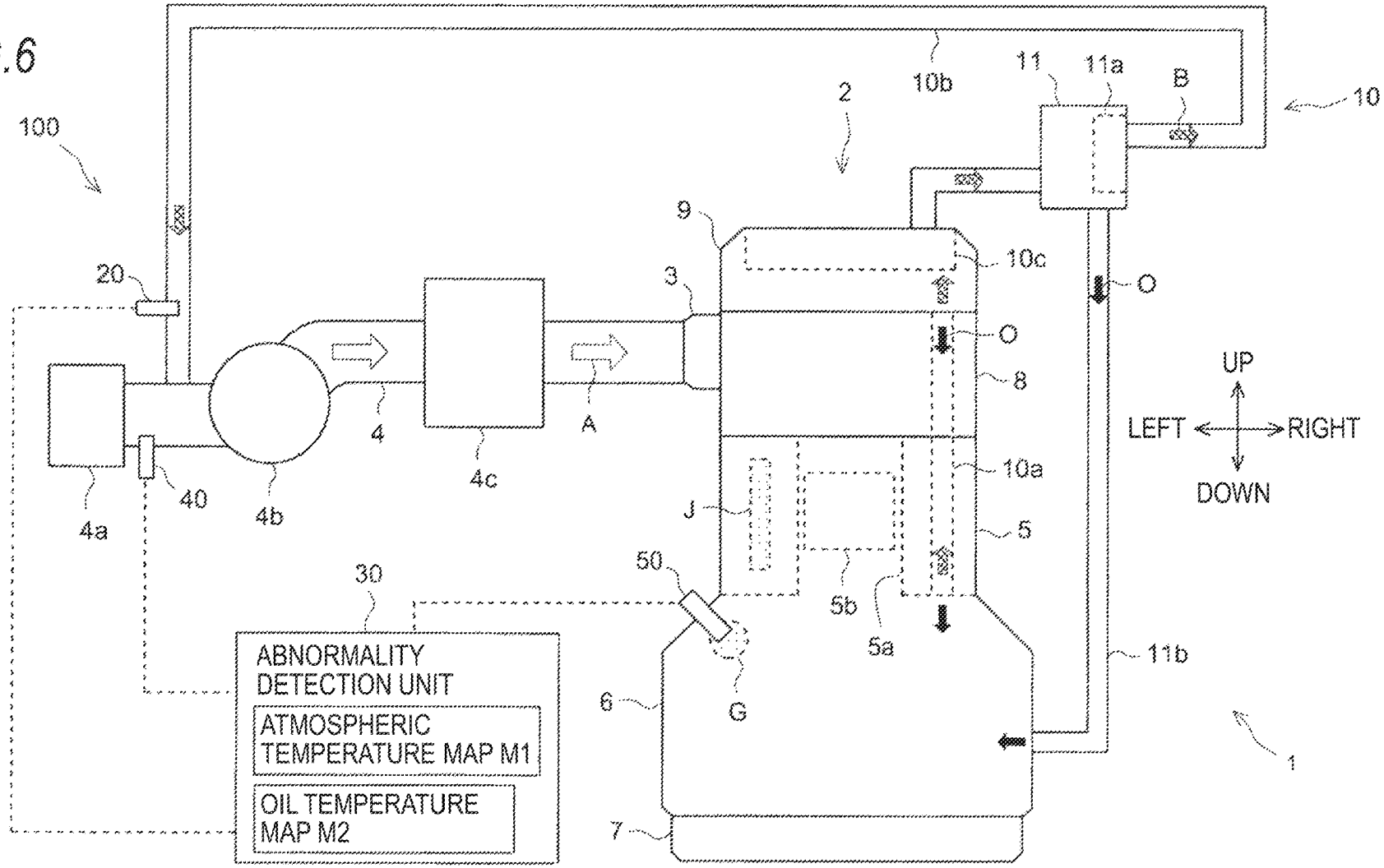
FIG. 6 is a schematic configuration diagram of an internal combustion engine in a first modification example.

The blow-by gas may be returned to the intake pipe 4 without being released into the atmosphere from the blow-by gas pipe 10*b*. Specifically, as illustrated in FIG. 6, a downstream end of the blow-by gas pipe 10*b* of a first modification example is connected to a part of the intake pipe 4 which is the part located between the atmospheric temperature sensor 40 and the compressor 4*b*.

SECOND MODIFICATION EXAMPLE

Parameters other than the atmospheric temperature and the oil temperature may be used to correct the normality threshold value $T_L$ and the abnormality threshold value $T_H$.

Figure 7:
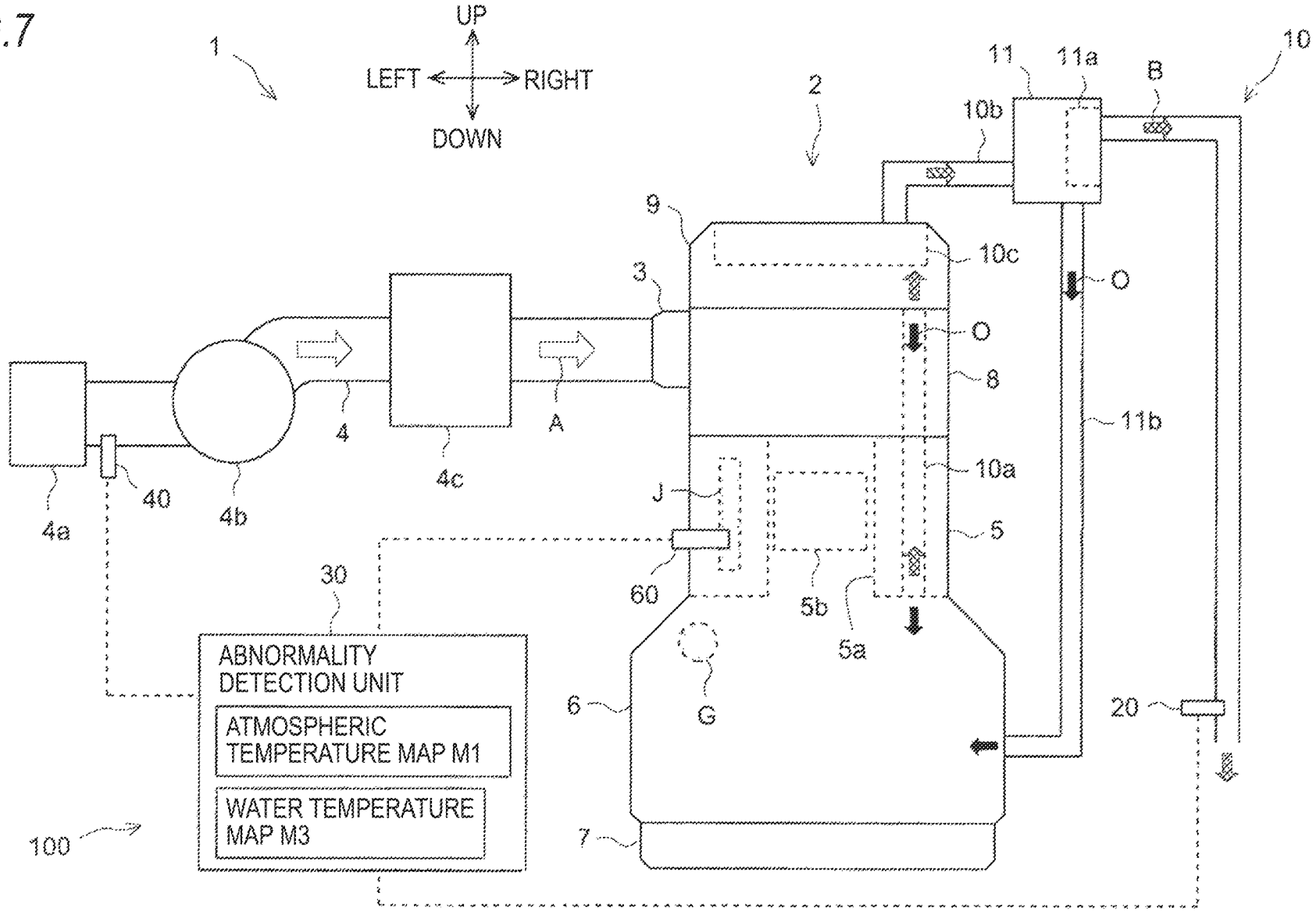
FIG. 7 is a schematic configuration diagram of an internal combustion engine in a second modification example.
Figure 8:
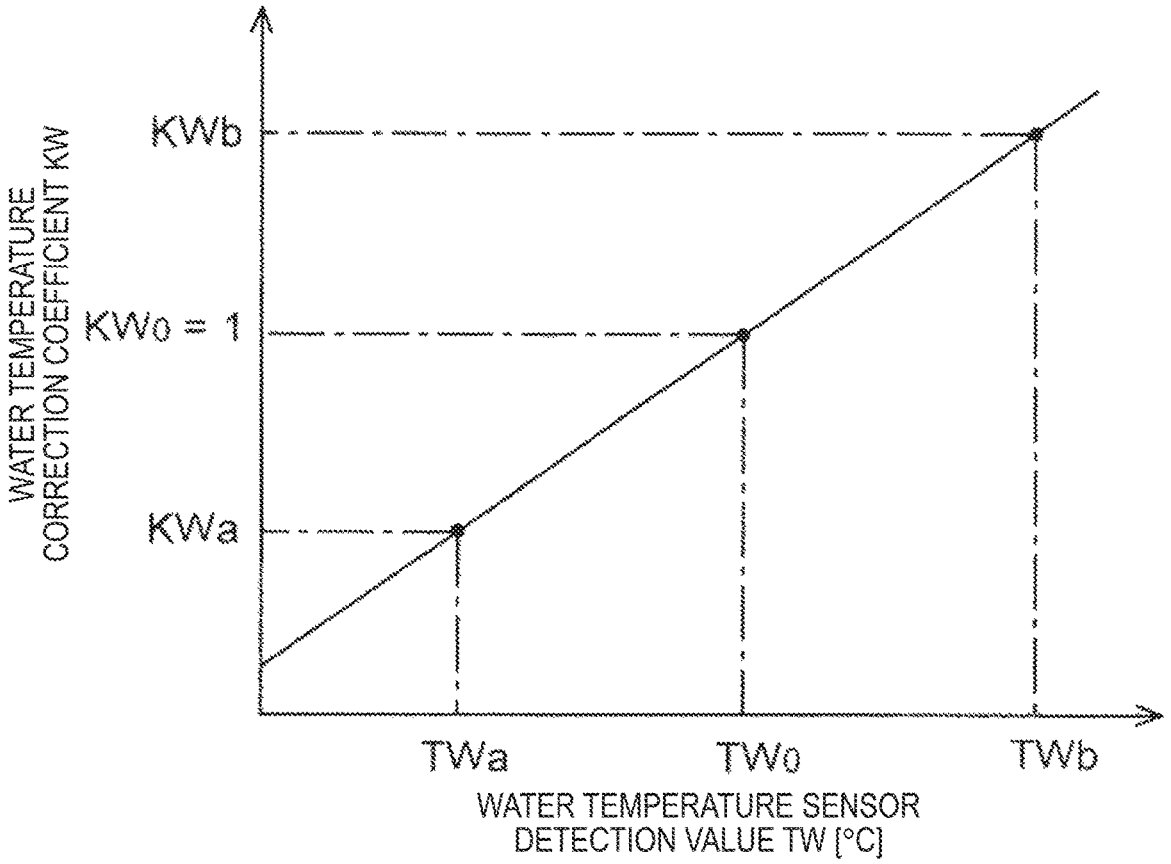
FIG. 8 is a map which defines a relationship between a temperature of engine cooling water in the second modification example and a correction coefficient corresponding to the temperature.
Figure 9:
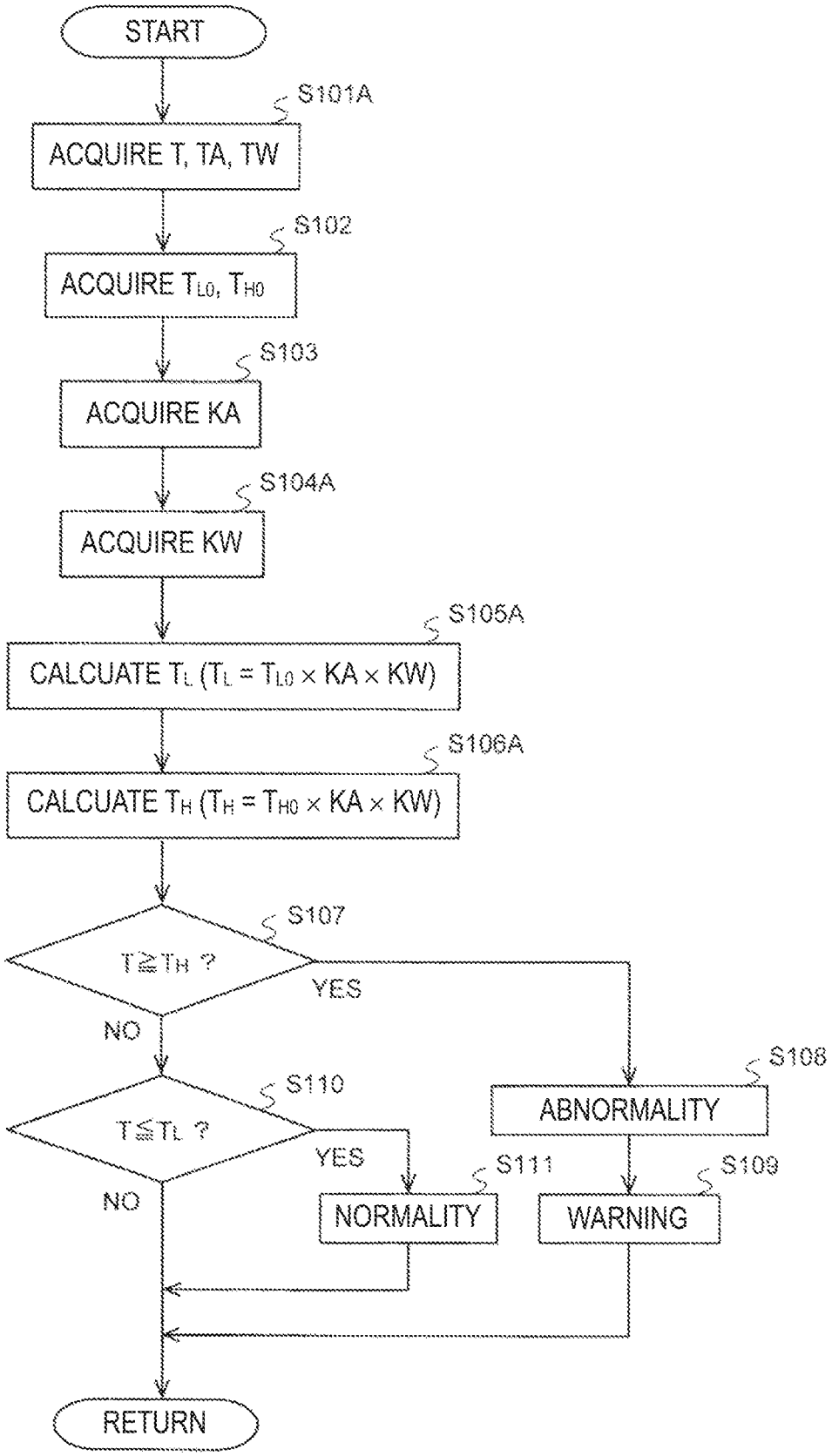
FIG. 9 is a diagram illustrating a control flow of an abnormality detection unit in the second modification example.

For example, as illustrated in FIGS. 7 to 9, in a second modification example, a temperature (hereinafter, referred to as the water temperature) of the engine cooling water is used instead of the oil temperature in the correction of the normality threshold value $T_L$ and the abnormality threshold value $T_H$. Since the engine cooling water has a correlation with the oil temperature only at a temperature lower than the oil temperature by a certain temperature (for example, 10° C.), it can be a parameter for correcting the threshold values $T_L$ and $T_H$ as similar to the oil temperature.

Specifically, as illustrated in FIG. 7, in the second modification example, the oil temperature sensor 50 is omitted, and instead, a water temperature sensor 60 attached to the water jacket J to detect the water temperature is used. Further, the abnormality detection unit 30 of the second modification example includes a water temperature map M3 instead of the oil temperature map M2. As illustrated in FIG. 8, with respect to the oil temperature map M2 illustrated in FIG. 4, the water temperature map M3 replaces the detected oil temperature TO with a detected value (hereinafter, detected water temperature) TW of the water temperature sensor 60 and replaces the oil temperature correction coefficient KO with a correction coefficient (hereinafter, water temperature correction coefficient) KW corresponding to the detected water temperature TW.

Further, as illustrated in FIG. 9, in a control flow of the second modification example, Steps S101 and 104 to 106 illustrated in FIG. 5 are replaced with Steps S101A and 104A to 106A. In Step S101A, the detected in-pipe temperature T, the detected atmospheric temperature TA, and the detected water temperature TW are acquired, and in Step S104A, the water temperature correction coefficient KW is acquired. Then, in Steps S105A and S106A, the normality threshold value $T_L$ and the abnormality threshold value $T_H$ are calculated based on the atmospheric temperature correction coefficient KA and the water temperature correction coefficient KW.

THIRD MODIFICATION EXAMPLE

In addition to the atmospheric temperature and the oil temperature, other parameters may be used to correct the normality threshold value $T_L$ and the abnormality threshold value $T_H$.

Figure 10:
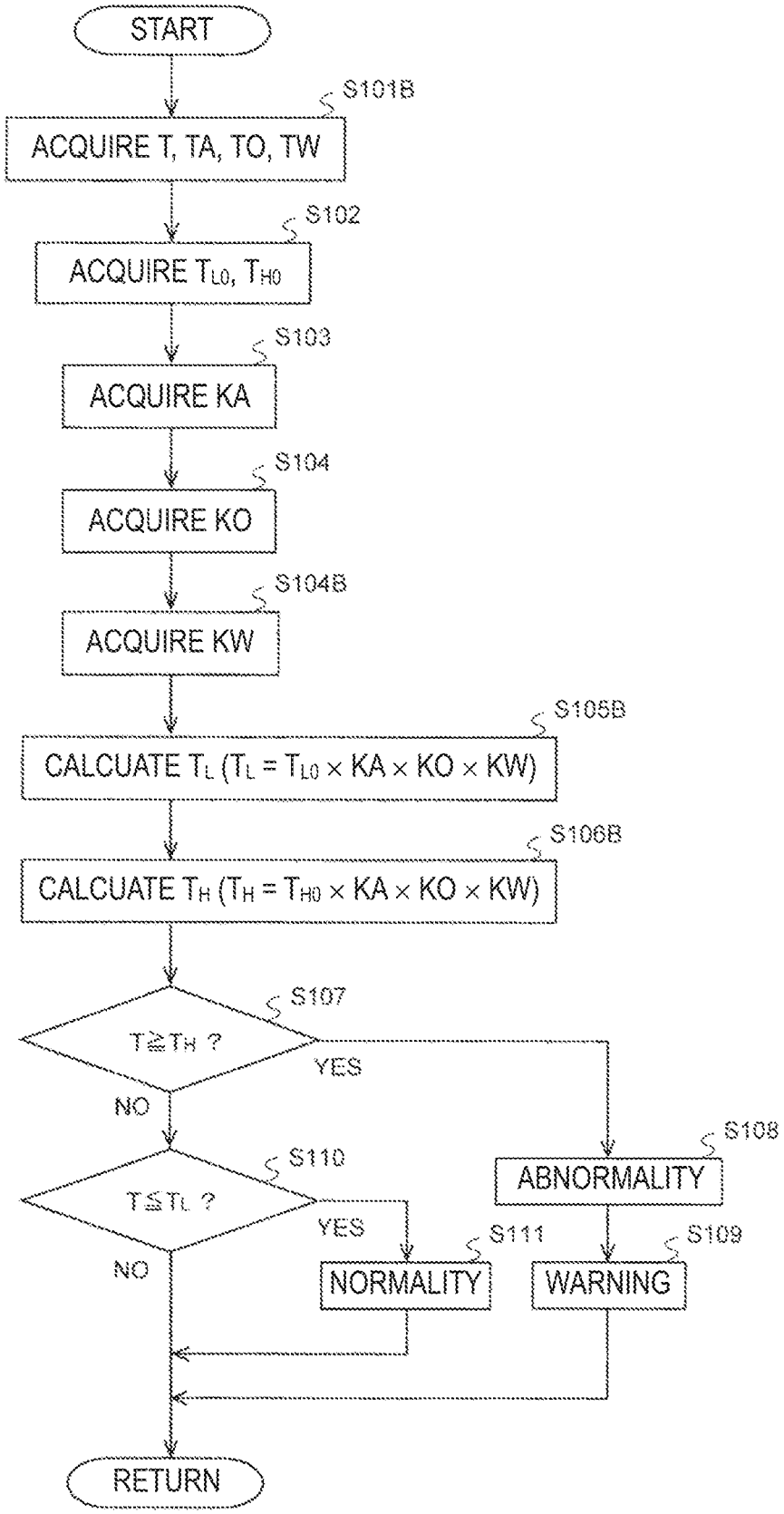
FIG. 10 is a diagram illustrating a control flow of an abnormality detection unit in a third modification example.

Specifically, as illustrated in FIG. 10, in a control flow of a third modification example, the water temperature is used as a parameter and Steps S101, S105, and S106 illustrated in FIG. 5 are replaced with Steps S101B, S105B, and S106B. Further, Step S104B is provided between Step S104 and Step S105B. In Step S101B, the detected in-pipe temperature T, the detected atmospheric temperature TA, the detected oil temperature TO, and the detected water temperature TW are acquired, and in step S104B, the water temperature correction coefficient KW is acquired. Then, in Steps S105B and S106B, the normality threshold value $T_L$ and the abnormality threshold value $T_H$ are calculated based on the atmospheric temperature correction coefficient KA, the oil temperature correction coefficient KO, and the water temperature correction coefficient KW.

FOURTH MODIFICATION EXAMPLE

The normality threshold value $T_L$ and the abnormality threshold value $T_H$ may be corrected based on only one parameter (for example, atmospheric temperature).

FIFTH MODIFICATION EXAMPLE

Although not illustrated, the normality threshold value $T_L$ and the abnormality threshold value $T_H$ need not be corrected. Specifically, the abnormality detection unit 30 of a fifth modification example compares the detected in-pipe temperature T with the reference normality threshold value $T_{L0}$ and the reference abnormality threshold value $T_{H0}$ to detect the normality and abnormality of the internal combustion engine.

SIXTH MODIFICATION EXAMPLE

Instead of correcting the normality threshold value $T_L$ and the abnormality threshold value $T_H$, the detected in-pipe temperature T may be corrected. Specifically, the abnormality detection unit 30 of a sixth modification example calculates a corrected detected in-pipe temperature T' by dividing the detected in-pipe temperature T by the atmospheric temperature correction coefficient KA and the oil temperature correction coefficient KO ($T'=T/(KA\times KO)$). Then, the corrected detected in-pipe temperature T' is compared with the reference normality threshold value $T_{L0}$ and the reference abnormality threshold value $T_{H0}$ to detect the normality and abnormality of the internal combustion engine.

SEVENTH MODIFICATION EXAMPLE

Of the normality threshold value $T_L$ and the abnormality threshold value $T_H$, the normality threshold value $T_L$ may be omitted. In a seventh modification example, only whether the detected in-pipe temperature T is equal to or greater than the abnormality threshold value $T_H$ is determined.

EIGHTH MODIFICATION EXAMPLE

When the temperature difference between the detected in-pipe temperatures T during normal and abnormal conditions is clear, the oil separator 11 may be omitted from the blow-by gas pipe 10*b*.

NINTH MODIFICATION EXAMPLE

When the temperature difference between the detected in-pipe temperatures T during normal and abnormal conditions is clear, the temperature sensor 20 does not have to be located at the downstream side end portion of the blow-by gas pipe 10*b*. For example, the temperature sensor 20 of the ninth modification example is attached to the blow-by gas pipe 10*b* located immediately downstream of the oil separator 11.

The embodiment of the present disclosure is described in detail above. However, embodiments of the present disclosure are not limited to the embodiment described above and all modification examples, applications, and equivalents included in the ideas of the present disclosure defined by the claims are included in the present disclosure. Therefore, this disclosure should not be construed in a limited way and may be applied to any other technique which falls within the scope of the ideas of this disclosure.

This application is based on a Japanese patent application filed on Mar. 15, 2019 (Japanese Patent Application No. 2019-048605), the contents of which are incorporated herein by reference.

INDUSTRIAL APPLICABILITY

With the diagnosis device according to the present disclosure, the abnormality of the internal combustion engine can be detected based on the temperature in the blow-by gas passage.

REFERENCE SIGNS LIST

1: internal combustion engine
2: engine body
3: intake manifold
4: intake pipe
5: cylinder block
6: crankcase
7: oil pan
8: cylinder head
9: head cover
10: blow-by gas passage
10*a*: in-engine passage
10*b*: blow-by gas pipe
10*c*: oil separation chamber
11: oil separator
20: temperature sensor
30: abnormality detection unit

40: atmospheric temperature sensor
50: oil temperature sensor
100: diagnosis device
A: intake air
B: blow-by gas
O: oil separated from blow-by gas
$T_L$: normality threshold value
$T_H$: abnormality threshold value (threshold value)

The invention claimed is:

1. A diagnosis device for an internal combustion engine, the internal engine comprising a blow-by gas passage through which blow-by gas flows, the diagnosis device comprising:

a temperature sensor which detects a temperature inside the blow-by gas passage;

an atmospheric temperature sensor which detects an atmospheric temperature; and an abnormality detector including an atmospheric temperature map which defines a relationship between the atmospheric temperature detected by the atmospheric temperature sensor and a correction coefficient, wherein the abnormality detector detects an abnormality by comparing a detected value of the temperature sensor with a corrected threshold value, and wherein the abnormality detector periodically updates the corrected threshold value by multiplying a reference threshold value by the correction coefficient corresponding to the atmospheric temperature detected by the atmospheric temperature sensor defined by the atmospheric temperature map.

2. The diagnosis device for the internal combustion engine according to claim 1, wherein the abnormality detector detects an abnormality by comparing the detected value of the temperature sensor with the reference threshold value, and corrects the reference threshold value based on at least one of the atmospheric temperature, a temperature of engine oil, and a temperature of engine cooling water.

3. The diagnosis device for the internal combustion engine according to claim 2, wherein the abnormality detector corrects the threshold value to a higher value as at least one of the atmospheric temperature, the temperature of engine oil, and the temperature of engine cooling water is higher.

4. The diagnosis device for the internal combustion engine according to claim 1, wherein the temperature sensor is configured to be located in the blow-by gas passage on a downstream side of an oil separator in the blow-by gas passage.

5. The diagnosis device for the internal combustion engine according to claim 1, wherein the temperature sensor is configured to be located at a downstream side end portion of the blow-by gas passage, the downstream side end portion being opened to an atmosphere.

* * * * *